US012241673B2

(12) United States Patent
Park

(10) Patent No.: US 12,241,673 B2
(45) Date of Patent: Mar. 4, 2025

(54) REFRIGERATOR

(71) Applicant: LG Electronics Inc., Seoul (KR)

(72) Inventor: Dongwoo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 279 days.

(21) Appl. No.: 17/631,634

(22) PCT Filed: Jul. 31, 2020

(86) PCT No.: PCT/KR2020/010162
§ 371 (c)(1),
(2) Date: Jan. 31, 2022

(87) PCT Pub. No.: WO2021/025395
PCT Pub. Date: Feb. 11, 2021

(65) Prior Publication Data

US 2022/0275992 A1 Sep. 1, 2022

(30) Foreign Application Priority Data

Aug. 2, 2019 (KR) ..... 10-2019-0094399

(51) Int. Cl.
*F17C 3/08* (2006.01)
*F25D 17/06* (2006.01)
(Continued)

(52) U.S. Cl.
CPC ..... *F25D 17/065* (2013.01); *F25D 17/067* (2013.01); *F25D 17/08* (2013.01);
(Continued)

(58) Field of Classification Search
CPC ..... F25D 17/08; F25D 17/065; F25D 23/006; F25D 2317/067; F25D 2317/066; F25D 2317/0671
See application file for complete search history.

(56) References Cited

U.S. PATENT DOCUMENTS 5,787,725 A * 8/1998 Shin ..... F25D 17/065 62/276
6,293,122 B1 * 9/2001 Chang ..... F25D 17/065 62/414
(Continued)

FOREIGN PATENT DOCUMENTS

CN 207741397 U 8/2018
KR 10-2000-0028922 A 5/2000
(Continued)

OTHER PUBLICATIONS

Office Action in Australian Appln. No. 2020324850, dated Oct. 20, 2022, 4 pages.
(Continued)

*Primary Examiner* — Brian M King
(74) *Attorney, Agent, or Firm* — Fish & Richardson P.C.

(57) ABSTRACT

Proposed is a refrigerator in which the internal air of a first storage compartment of two storage compartments whose temperatures are controlled by an evaporator is reintroduced into the evaporator by a circulating air path guide to be circulated, whereby even if an evaporator having small capacity is applied, freezing or refrigeration temperature may be freely embodied, and the circulation of cold air can be efficiently performed without interference.

17 Claims, 10 Drawing Sheets

(51) Int. Cl.
*F25D 17/08* (2006.01)
*F25D 23/00* (2006.01)

(52) U.S. Cl.
CPC .... *F25D 23/006* (2013.01); *F25D 2317/0667* (2013.01); *F25D 2317/068* (2013.01)

(56) References Cited

U.S. PATENT DOCUMENTS

| | | | | |
|---|---|---|---|---|
| 6,401,482 | B1 * | 6/2002 | Lee | F25D 23/023 62/414 |
| 8,087,261 | B2 * | 1/2012 | Lee | F25D 21/08 454/359 |
| 9,581,377 | B2 | 2/2017 | Kim et al. | |
| 2018/0087814 | A1 | 3/2018 | Han et al. | |
| 2019/0331403 | A1 * | 10/2019 | Cho | F25D 21/14 |

FOREIGN PATENT DOCUMENTS

| | | | |
|---|---|---|---|
| KR | 100389382 | | 10/2003 |
| KR | 20040048766 | A | 6/2004 |
| KR | 10-2011-0098413 | A | 9/2011 |
| WO | WO 2019059650 | A1 | 3/2019 |

OTHER PUBLICATIONS

Extended European Search Report in European Appln. No. 20849734.7, mailed on Jul. 31, 2023, 5 pages.
Office Action in Korean Appln. No. 10-2019-0094399, mailed on Jun. 3, 2024, 12 pages (with English translation).

* cited by examiner

REFRIGERATOR

CROSS-REFERENCE TO RELATED APPLICATIONS

This application is a National Stage application under 35 U.S.C. § 371 of International Application No. PCT/KR2020/010162, filed on Jul. 31, 2020, which claims the benefit of Korean Patent Application No. 10-2019-0094399, filed on Aug. 2, 2019. The disclosures of the prior applications are incorporated by reference in their entirety.

TECHNICAL FIELD

The present disclosure relates to a refrigerator which has at least two storage compartments partitioned from each other.

BACKGROUND ART

Generally, a refrigerator is a home appliance that is provided to store various foods for a long time with cold air generated by using the circulation of a refrigerant according to a refrigeration cycle.

Such a refrigerator is provided to have a plurality of spaces partitioned from each other, wherein each of the partitioned spaces is configured to be used as a refrigerating compartment, a freezer compartment, or a storage compartment according to the need thereof.

Particularly, a kimchi refrigerator has at least three partitioned spaces, and each of the spaces is maintained at a temperature for performing different functions such as the fermentation, ripening, or long-term storage of kimchi.

However, conventional normal kimchi refrigerators disclosed in Korean Patent Application Publication Nos. 10-2000-0060146 and 10-2000-0041968 are configured such that a temperature control for each of at least two or three storage compartments is performed by using one evaporator, so it is not easy to control temperatures of the at least two storage compartments with large temperature difference therebetween.

Recently, Korean Patent Application Publication Nos. 10-2015-0045796 (prior art 1), 10-2004-0038307 (prior art 2), and 10-2006-0023367 (prior art 3) disclose technologies in which temperatures of storage compartments different from each other are controlled by at least two evaporators.

Particularly, in the cases of prior art 1 and prior art 2 among the prior arts described above, storage compartments for different uses (for example, a storage compartment for freezing and a storage compartment for refrigeration) are configured such that temperature controls thereof can be achieved by using different evaporators, and two storage compartments for the same or similar use (for example, a storage compartment for ripening kimchi and a storage compartment for storing kimchi) are configured to simultaneously control temperatures by a single evaporator, and accordingly, a refrigerator having at least three storage compartments is configured such that each of the storage compartments can be used for a different use.

However, prior art 1 described above is difficult to be applied to the refrigerator (when seen relative to prior art 1, a refrigerator in which two upper refrigerating compartments are configured as a storage space or the refrigerator disclosed in prior art 2) which has a single storage compartment located at the upper part of the refrigerator and using a swinging door and has two storage compartments arranged vertically at the lower part of the refrigerator and having drawer-type doors.

Additionally, in the case of prior art 2, an evaporator applied to two lower storage compartments is configured to be open to the two storage compartments, so different temperatures of the two storage compartments are difficult to be controlled.

Furthermore, in the case of prior art 2, air introduction into and air discharge from the evaporator provided for controlling temperatures of a plurality of storage compartments are not clearly separated from each other, and thus air does not efficiently pass through the associated evaporator, so refrigeration efficiency is inevitably reduced.

DISCLOSURE

Technical Problem

The present disclosure has been made to solve the above problems occurring in the prior art, and the present disclosure is intended to propose a refrigerator of a new type in which individual temperature control for each of a plurality of storage compartments can be easily performed.

In addition, the present disclosure is intended to propose a refrigerator of a new type in which the heat exchange of air passing through a first end of the evaporator and a second end thereof is sufficiently performed such that refrigeration efficiency can be improved.

Furthermore, the present disclosure is intended to propose a refrigerator of a new type in which cold air can be efficiently circulated in two storage compartments using the same evaporator and the inlet part of the evaporator through which air is circulated and introduced into the evaporator from the two storage compartments is located at the same position so as to improve refrigeration efficiency.

Technical Solution

In order to accomplish the above objectives, a refrigerator of the present disclosure may be configured such that internal air of a first storage compartment of the first storage compartment and a second storage compartment whose temperatures are controlled by the same evaporator may be reintroduced into the evaporator by a separate flow path guide to be circulated. Accordingly, even if an evaporator having small capacity is applied, freezing or refrigeration temperature may be freely embodied.

In addition, the refrigerator of the present disclosure may include a circulating air path guide. Accordingly, flow resistance due to the collision of air reintroduced into the evaporator from the second storage compartment with air reintroduced into the evaporator from the first storage compartment may be prevented.

Furthermore, in the refrigerator of the present disclosure, the circulating air path guide may be configured to discharge air through each of the opposite wall surfaces of the first storage compartment. Accordingly, the concern of air freezing may be released.

Additionally, the refrigerator of the present disclosure may be configured such that one evaporator and two dampers perform the control of different temperatures of two storage compartments. Accordingly, a flow path structure may be simplified.

In addition, in the refrigerator of the present disclosure, the evaporator may be located at a rear portion of a partitioning frame partitioning two storage compartments from each other. Accordingly, air discharged from the second storage compartment may efficiently flow toward the air inlet part of the evaporator.

Furthermore, the refrigerator of the present disclosure may be configured such that air is introduced into and passes through the evaporator from the lower side thereof and then flows to a blower fan located above the evaporator. Accordingly, the loss of an air flow may be prevented and the heat exchange efficiency of the evaporator may be improved.

Additionally, the refrigerator of the present disclosure may be configured such that a grille fan assembly constitutes the rear wall of the first storage compartment and the second storage compartment. Accordingly, the structure of the refrigerator may be simplified.

In addition, in the refrigerator of the present disclosure, the blower fan may be mounted to a rear cover of the grille fan assembly.

Furthermore, in the refrigerator of the present disclosure, a guide duct may be formed on at least one surface of the opposing surfaces of the rear and front covers of the grille fan assembly. Accordingly, the flow of cold air into each of the storage compartments may be uniformly and efficiently performed.

Additionally, in the refrigerator of the present disclosure, the guide duct may be configured by being divided into a first guide duct for supplying cold air into the first storage compartment and a second guide duct for supplying cold air into the second storage compartment. Accordingly, cold air required by each of the storage compartments may be supplied thereto by a single evaporator.

In addition, in the refrigerator of the present disclosure, each of the guide ducts may include a damper for opening and closing a flow path. Accordingly, individual temperature control for each of the storage compartments may be performed.

Furthermore, in the refrigerator of the present disclosure, the evaporator may be located at a lower portion of space between the grille fan assembly and an inner casing. Accordingly, a structural design for air introduction from each of the storage compartments may be efficiently made.

Additionally, in the refrigerator of the present disclosure, an inlet duct may be formed on the lower portion of the front cover. Accordingly, cold air inside the second storage compartment may be efficiently guided to the evaporator.

In addition, the refrigerator of the present disclosure may be configured such that the flow of circulating cold air is guided to the lower side of the evaporator through the circulating air path guide. Accordingly, the heat exchange efficiency of the evaporator may be improved.

Furthermore, in the refrigerator of the present disclosure, the circulating air path guide may be configured to receive air of the inside of the first storage compartment from the opposite sides thereof. Accordingly, cold air inside the first storage compartment may be distributed evenly to opposite sides thereof.

Additionally, in the refrigerator of the present disclosure, the circulating air path guide may be configured to receive cold air contained inside the first storage compartment from the lower ends of the rears of the opposite sides of the first storage compartment. Accordingly, cold air introduced into the first storage compartment may sufficiently cool the inside of the first storage compartment and then be discharged.

In addition, in the refrigerator of the present disclosure, the circulating air path guide may be configured by being divided into two storage compartment ducts and an evaporator duct. Accordingly, the circulating air path guide may be easily manufactured.

Furthermore, in the refrigerator of the present disclosure, the evaporator duct may include two connecting ends, wherein the two connecting ends may be configured to be connected to the two storage compartment ducts, respectively. Accordingly, even air flows to the opposite sides of the inside of the first storage compartment may be performed without an air flow being concentrated on one side.

Additionally, in the refrigerator of the present disclosure, the two connecting ends of the evaporator duct and the two storage compartment ducts may be coupled removably to each other. Accordingly, disassembly and reassembly thereof for maintenance may be easily performed.

Advantageous Effects

In the refrigerator of the present disclosure described above, air contained inside one storage compartment (the first storage compartment) of two storage compartments whose temperatures are controlled by the evaporator may be reintroduced into the evaporator by the circulating air path guide to be circulated, thereby freely embodying freezing or refrigeration temperature even if the evaporator having small capacity is applied.

Furthermore, in the refrigerator of the present disclosure, a separate circulating air path guide may be used, thereby preventing the flow interference of air reintroduced into the evaporator from the second storage compartment with air reintroduced into the evaporator from the first storage compartment.

Furthermore, in the refrigerator of the present disclosure, the circulating air path guide may discharge air through the opposite surfaces of the first storage compartment, thereby releasing the concern of air freezing.

Furthermore, in the refrigerator of the present disclosure, one evaporator and two dampers may control different temperatures of the two storage compartments, thereby simplifying the structure of temperature control.

Furthermore, in the refrigerator of the present disclosure, the evaporator may be installed to be located at a portion behind the partitioning frame partitioning the two storage compartments from each other, thereby facilitating the flow of air discharged from the second storage compartment toward the air inlet part of the evaporator.

Furthermore, in the refrigerator of the present disclosure, the evaporator may be located between the first storage compartment and the second storage compartment, thereby sufficiently securing the size (capacity) of the evaporator and securing space for forming the first guide duct which guides an air flow to the upper side of the first storage compartment.

Furthermore, the refrigerator of the present disclosure may be configured such that air is introduced into and passes through the evaporator from a lower side thereof and then flows to the blower fan located above the evaporator, thereby preventing the loss of an air flow and improving the heat exchange efficiency of the evaporator.

Furthermore, in the refrigerator of the present disclosure, the front cover of the grille fan assembly may constitute the rear wall surface of each of the first storage compartment and the second storage compartment, thereby simplifying the structure of the rear wall surface thereof.

Furthermore, in the refrigerator of the present disclosure, the blower fan may be mounted to the rear cover of the grille fan assembly and each guide duct may be formed on the front surface of the rear cover, thereby enabling the flow of cold air into each of the storage compartments to be uniformly and efficiently performed.

Furthermore, in the refrigerator of the present disclosure, the guide duct may be formed to be divided into the first guide duct for the supply of cold air to the first storage compartment and the second guide duct for the supply of cold air to the second storage compartment, and each of the guide ducts may be provided with a damper for opening and closing a flow path, thereby enabling individual temperature control for each of the storage compartments.

Furthermore, in the refrigerator of the present disclosure, the evaporator may be located at a lower portion between the grille fan assembly and the inner casing, thereby facilitating a structural design for air introduction to the evaporator from each of the storage compartments.

Furthermore, in the refrigerator of the present disclosure, the inlet duct may be formed on the lower portion of the front cover, thereby efficiently guiding cold air inside the second storage compartment to the evaporator.

Furthermore, the refrigerator of the present disclosure may be configured such that the flow of circulating cold air is guided to the lower side of the evaporator through the circulating air path guide instead of being introduced into the center or side portion of the evaporator, thereby improving the heat exchange efficiency of the evaporator.

Furthermore, in the refrigerator of the present disclosure, the circulating air path guide may be configured to receive cold air contained inside the first storage compartment from the opposite sides of the first storage compartment, thereby evenly distributing the cold air of the inside of the first storage compartment to opposite sides thereof.

Furthermore, in the refrigerator of the present disclosure, the circulating air path guide may be configured to receive cold air contained inside the first storage compartment from the lower ends of the rears of the opposite sides of the first storage compartment, thereby enabling the cold air introduced into the first storage compartment to sufficiently cool the inside of the first storage compartment and then to be discharged.

Furthermore, in the refrigerator of the present disclosure, the circulating air path guide may be configured by being divided into the two storage compartment ducts and the evaporator duct, thereby facilitating the manufacturing of the circulating air path guide.

Furthermore, in the refrigerator of the present disclosure, the evaporator duct may include the two connecting ends which are connected to the two storage compartment ducts, thereby realizing the even flow of air to the opposite sides of the inside of the first storage compartment without an air flow being concentrated on one side.

Furthermore, in the refrigerator of the present disclosure, the two connecting ends of the evaporator duct and the two storage compartment ducts may be configured to be coupled removably to each other, thereby facilitating disassembly and assembly thereof for maintenance.

MODE FOR INVENTION

Hereinbelow, the exemplary embodiment of the refrigerator of the present disclosure will be described with reference to FIGS. 1 to 11.

Prior to the description of the embodiment, the refrigerator of the present disclosure, for an example, may have a refrigerating compartment located at an upper side thereof and opened and closed by a swinging door, and may have a kimchi refrigerator located at a lower side thereof and having two storage compartments opened and closed by drawer-type doors.

Figure 1:
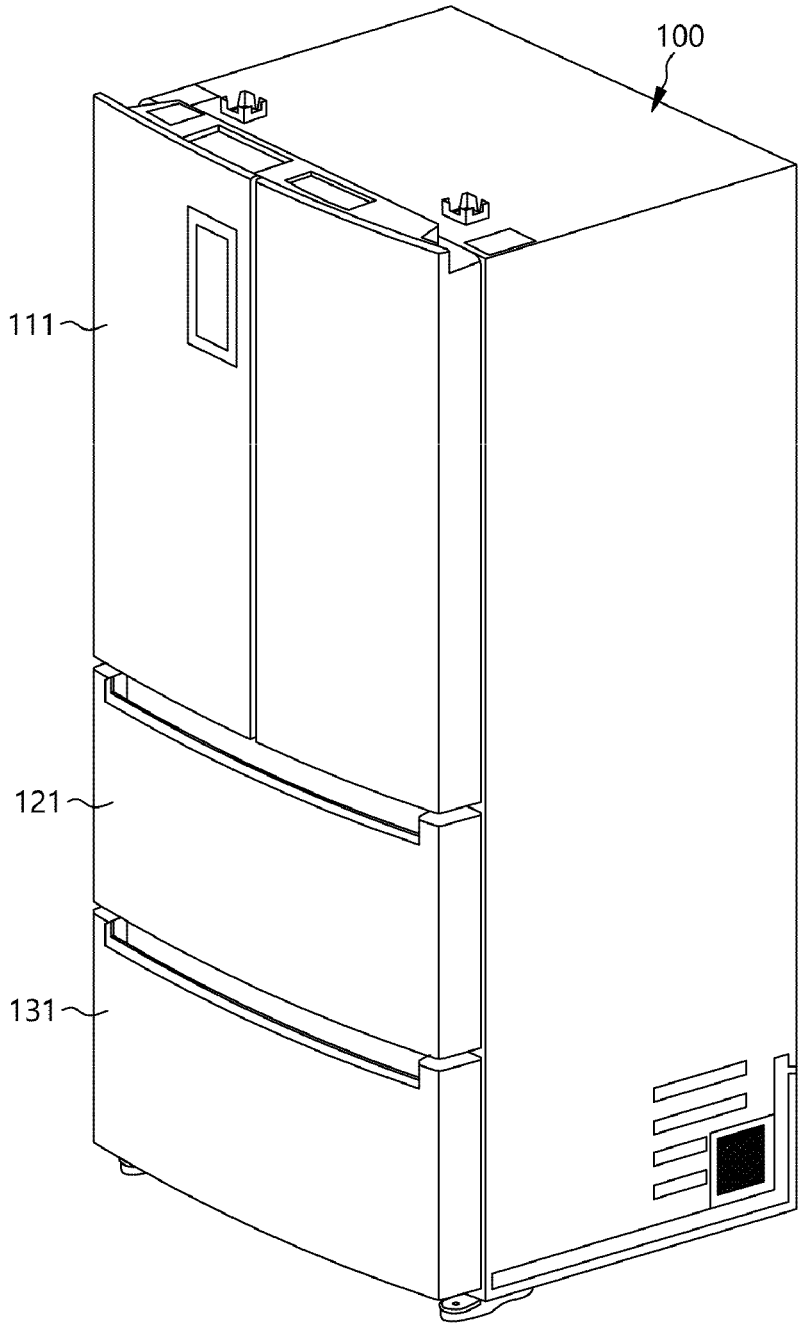
FIG. 1 is a perspective view illustrating the exterior of a refrigerator according to the embodiment of the present disclosure.
Figure 2:
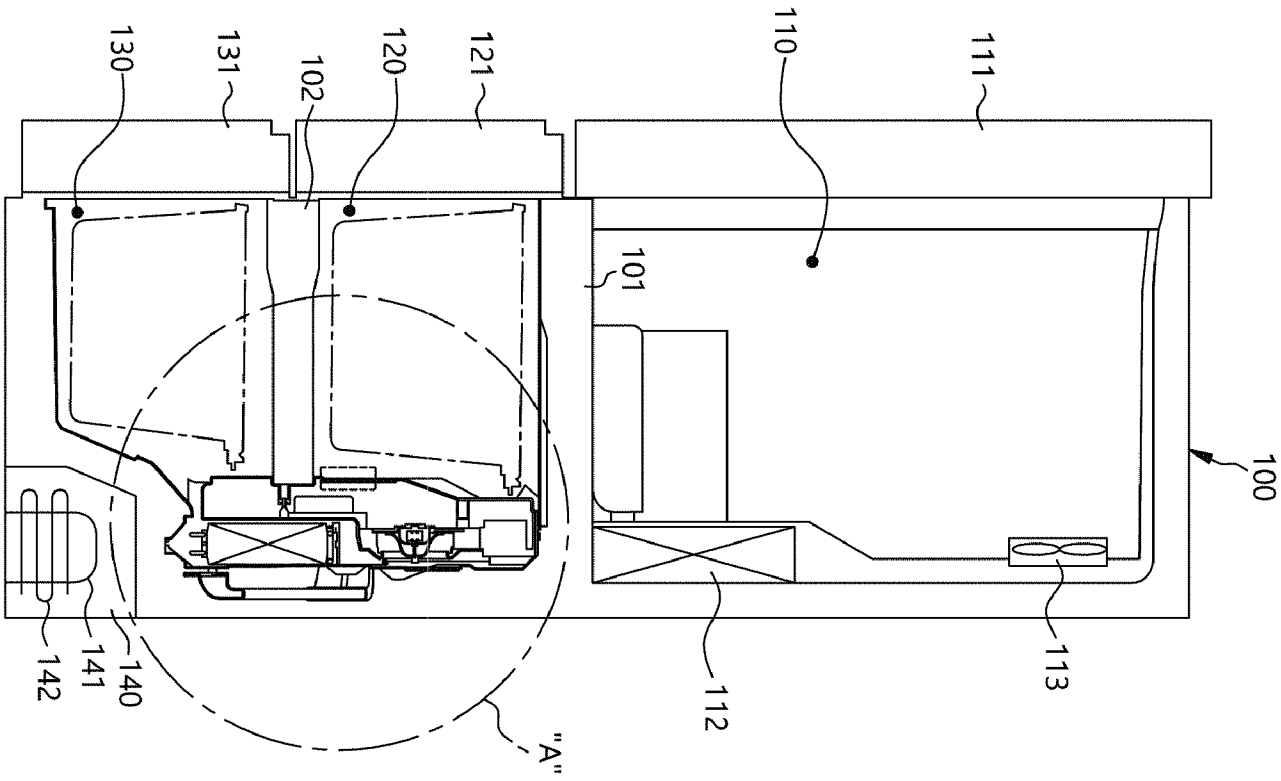
FIG. 2 is a sectional view illustrating the internal structure of the refrigerator according to the embodiment of the present disclosure.

FIG. 1 is a perspective view illustrating the exterior of the refrigerator according to the embodiment of the present disclosure, and FIG. 2 is a sectional view illustrating the internal structure of the refrigerator according to the embodiment of the present disclosure.

As illustrated in these drawings, the refrigerator according to the embodiment of the present disclosure may largely include a main body casing 100, a grille fan assembly 200, an evaporator 300, and a circulating air path guide 400.

Particularly, the two storage compartments 120 and 130 having the same or similar characteristics may be configured such that temperatures thereof are controlled by one common evaporator 300, and a storage compartment 110 which has different characteristics from the two storage compartments 120 and 130 may be configured such that temperature thereof is controlled by a separate evaporator 112 (an upper evaporator).

Furthermore, the circulating air path guide 400 may be configured such that the flow of cold air supplied into each of the storage compartments 120 and 130 is not affected and the entire portion of the inside of each of the storage compartments 120 and 130 has even temperature.

This will be described in more detail for each component hereinbelow.

First, the main body casing 100 will be described.

The main body casing 100 may be a part constituting the exterior of the refrigerator.

Such a main body casing 100 may be configured as a box-shaped structure being open at a front thereof and having an inner space therein.

Particularly, the inner space inside the main body casing 100 may include the plurality of storage compartments 110, 120, and 130 partitioned vertically from each other by a plurality of partitioning frames 101 and 102. In this case, each of the partitioning frames 101 and 102 may be configured to constitute an insulated wall having an insulating material (not shown) provided therein.

In the embodiment of the present disclosure, the three storage compartments 110, 120, and 130 are provided as an example. In this case, the storage compartment 110 (an upper storage compartment) located at the upper space (the highest side) of the inner space may be configured to be opened and closed by the swinging door 111, and the storage compartment 120 (a first storage compartment) located at a middle space (a middle side) of the inner space and the storage compartment 130 (a second storage compartment) located at the lower space (the lowest side) of the inner space may be configured to be opened and closed by the drawer-type doors 121 and 131.

In addition, the upper storage compartment 110 may be configured to provide a greater storage capacity compared to the first storage compartment 120 and the second storage compartment 130.

Figure 3:
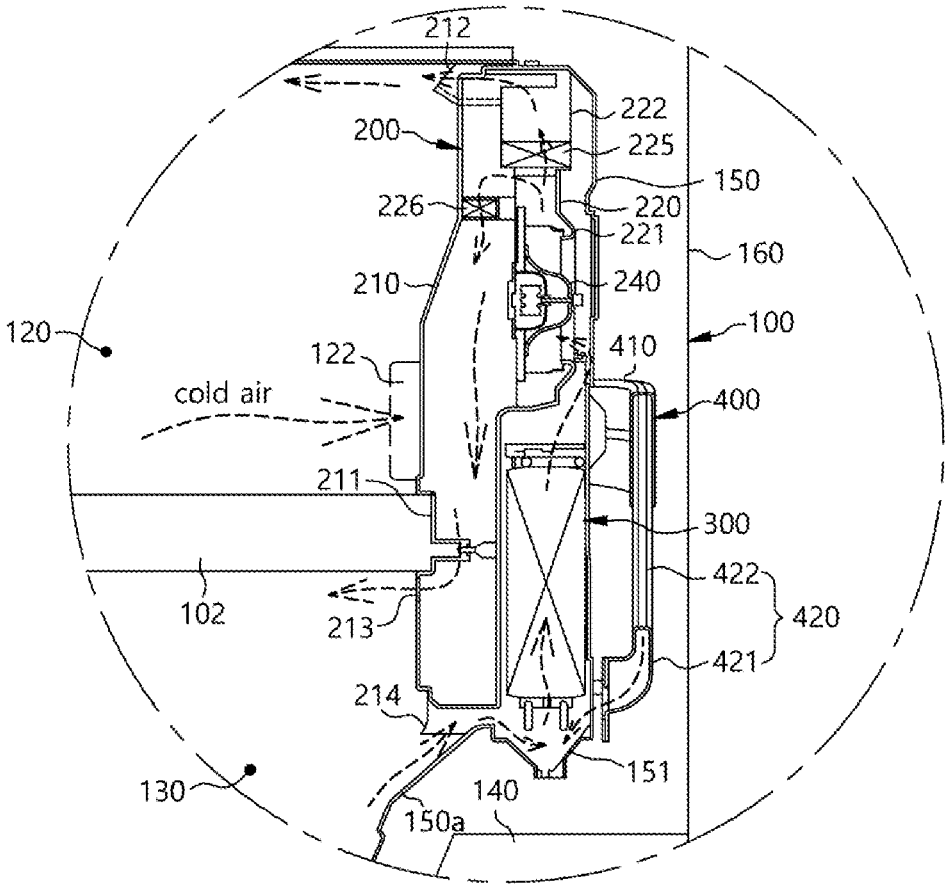
FIG. 3 is an enlarged view of an "A" part of FIG. 2.

Furthermore, as illustrated in FIG. 3, the main body casing 100 may include an inner casing 150 and an outer casing 160.

The inner casing 150 is a part which provides the first storage compartment 120 and the second storage compartment 130 and may be configured as a box body which is open at a front surface thereof and is empty therein.

In this case, the first storage compartment 120 and the second storage compartment 130 may be provided by being partitioned vertically from each other by the partitioning frame 102 crossing the middle of the inside of the inner casing 150.

In addition, the outer casing 160 may be a part constituting the exterior of the refrigerator and may be provided outside of the inner casing.

Furthermore, a machine room 140 may be provided at the rear side of a lower portion inside the main body casing 100. The machine room 140 may be a part in which a compressor 141 and a condenser 142 for a refrigeration system are located.

Particularly, the rear portion of the bottom surface 150*a* of the inner casing 150 may be formed to be bent in multiple steps (or inclined or round) in consideration of the structure of the machine room 140.

Meanwhile, the evaporator 112 (hereinafter, referred to as "the upper evaporator") may be provided in the lower space of the rear of the upper storage compartment 110 such that the evaporator 112 is partitioned from the inside of the upper storage compartment 110, and an upper blower fan 113 may be provided in the upper space of the rear of the upper storage compartment 110 such that the upper blower fan 113 blows air passing through the upper evaporator 112 into the upper storage compartment 110.

The upper evaporator 112 and the upper blower fan 113 may be controlled separately from the evaporator 300 and a blower fan 240 to be described later and may operate to control only the temperature of the upper storage compartment 110.

Next, the grille fan assembly 200 will be described.

The grille fan assembly 200 may be a component which guides the supply of cold air to each of the first storage compartment 120 and the second storage compartment 130 formed inside the main body casing 100.

Such a grille fan assembly 200 may be configured to be installed in rear space inside the first storage compartment 120 and the second storage compartment 130, and may include a front cover 210, a rear cover 220, and the blower fan 240 located between the two covers 210 and 220.

Here, the front cover 210 may be located to be exposed to the insides of the first storage compartment 120 and the second storage compartment 130 and may constitute the common rear wall of the inside of each of the first storage compartment 120 and the second storage compartment 130.

Particularly, the mounting recess part 211 for mounting the partitioning frame 102 may be formed on the middle portion of the front surface of the front cover 210. That is, the upper portion of the front cover 210 relative to the mounting recess part 211 may constitute the rear wall of the first storage compartment 120 and the lower portion of the front cover 210 relative to the mounting recess part 211 may constitute the rear wall of the second storage compartment 130.

In addition, the air discharge holes 212 and 213 may be formed in the front cover 210 such that the air discharge holes 212 and 213 respectively discharge air into the storage compartments 120 and 130. The air discharge holes 212 and 213 may include a first air discharge hole 212 which discharges air into the first storage compartment 120 and a second air discharge hole 213 which discharges air into the second storage compartment 130.

Figure 4:
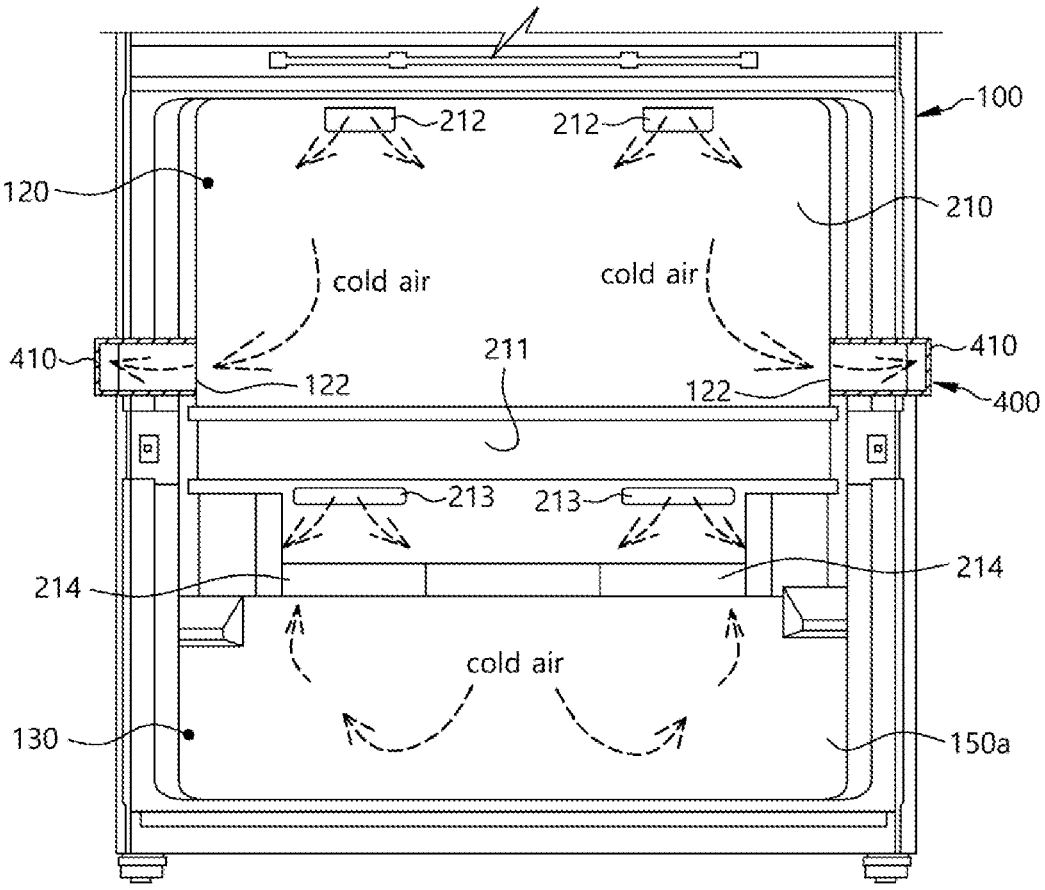
FIG. 4 is a front view illustrating the state of the inside of each of a first storage compartment and a second storage compartment in the internal structure of the refrigerator according to the embodiment of the present disclosure.

In this case, the first air discharge hole 212 may be formed in each of the opposite sides of the upper part of the front cover 210, and the second air discharge hole 213 may be formed in each of the opposite sides of the lower part of the front cover 210 (opposite sides directly below the mounting recess part). Particularly, the first air discharge holes 212 may be configured to be inclined toward the upper space of the first storage compartment 120. This is illustrated in FIGS. 3 and 4.

Furthermore, the inlet duct 214 may be formed on the lower end of the front cover 210 to guide cold air inside the second storage compartment 130 such that the cold air is introduced to a position between the lower portions of the rear cover 220 and the inner casing 150.

Figure 5:
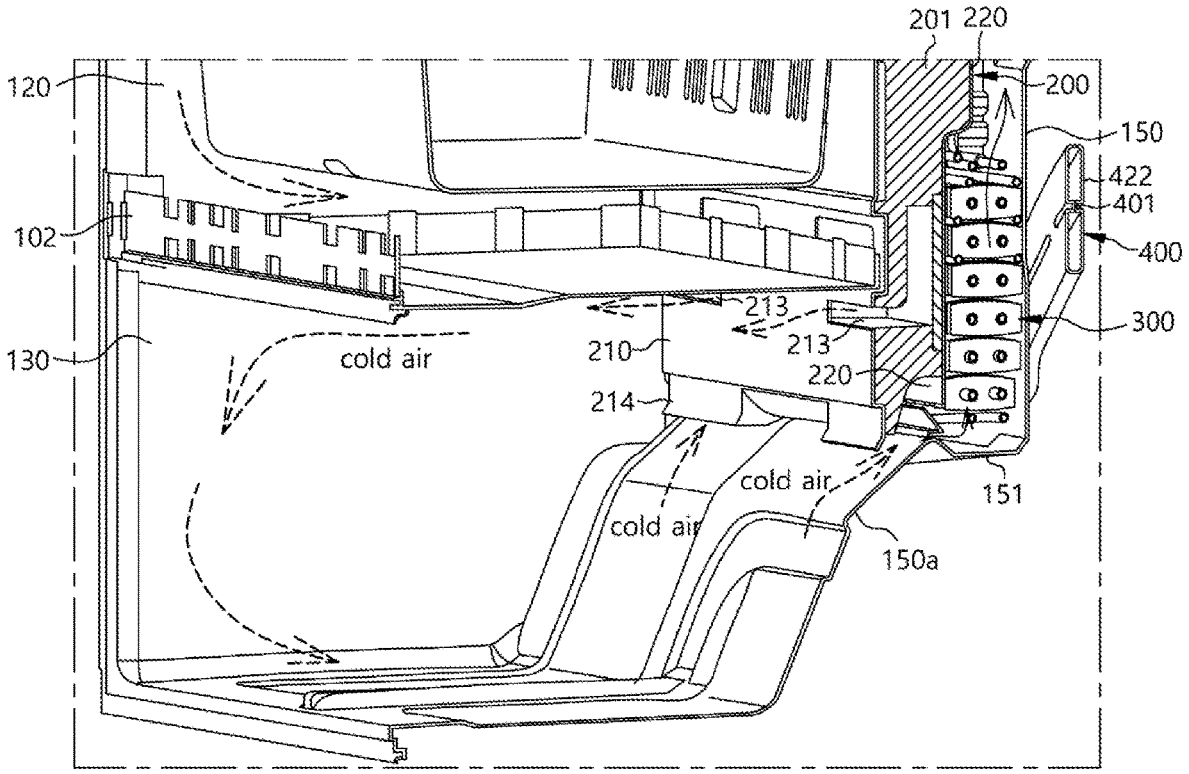
FIG. 5 is a cut-away perspective view of the refrigerator illustrated by cutting a portion of the refrigerator to describe a state in which air is introduced into the second storage compartment and is discharged to a grille fan assembly from the second storage compartment in the internal structure of the refrigerator according to the embodiment of the present disclosure.

In this case, the inlet duct 214 may be formed to be inclined or round in the same manner as or in a similar manner to the rear portion of the bottom surface 150*a* such that the inlet duct 214 efficiently receives the cold air of the inside of the second storage compartment 130 flowing along the inclination (bending) of the rear portion of the bottom surface 150*a* (a bottom surface in the main body casing) of the second storage compartment 130. This is illustrated in FIG. 5.

Additionally, the rear cover 220 to which the blower fan 240 is mounted may be a part by which an air flow is guided.

Such a rear cover 220 may be located behind the front cover 210, wherein a shroud 221 may be formed to be open on the rear cover 220 by protruding therefrom toward the inner casing 150, and the blower fan 240 may be installed inside the shroud 221.

Furthermore, the guide ducts 222, 223, and 224 may be formed on the front surface of the rear cover 220 so as to guide the flow of air blown by the blower fan 240.

The guide ducts 222, 223, and 224 may include a first guide duct 222 which receives air blown by the blower fan 240 and supplies the air to the first storage compartment 120, a second guide duct 223 which receives air blown by the blower fan 240 and supplies the air to the second storage compartment 130, and a third guide duct 224 guiding the flow of air blown by the blower fan 240 such that the flow of air is directed to the first guide duct 222 and the second guide duct 223.

Figure 6:
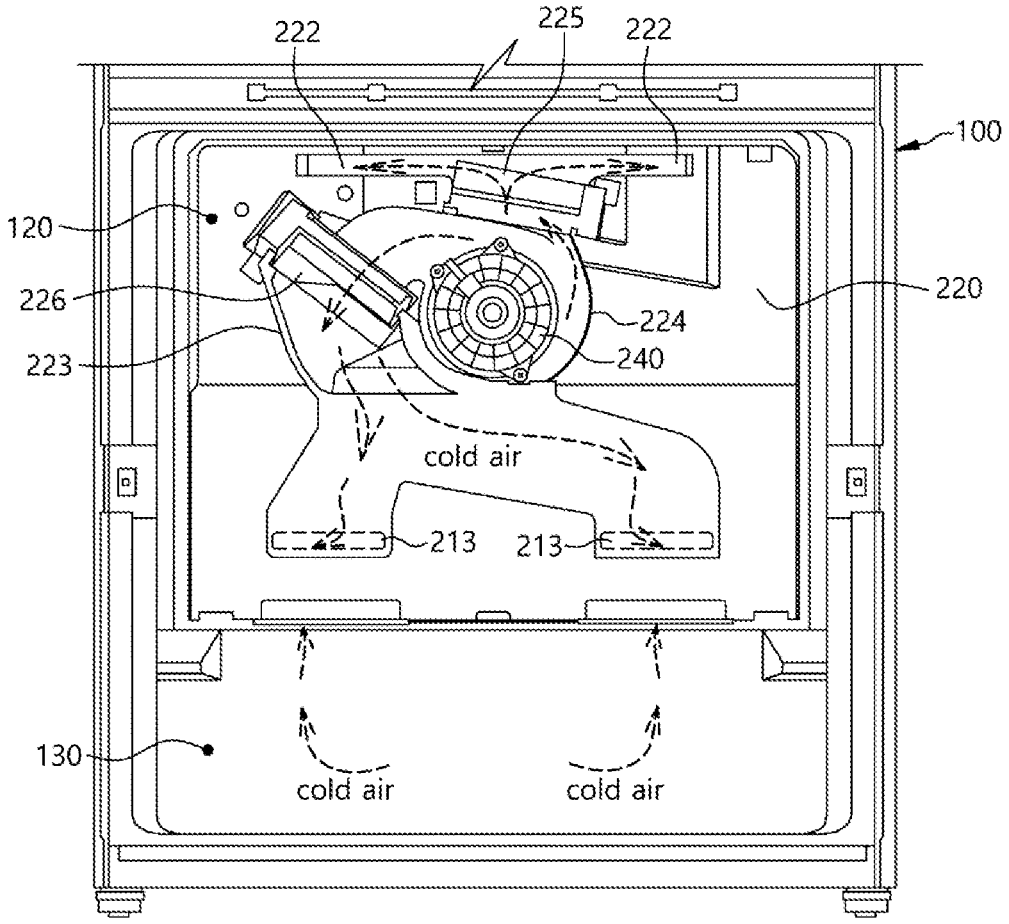
FIG. 6 is a view illustrating a state in which a front cover constituting the grille fan assembly is removed in the state of the refrigerator of FIG. 4.
Figure 7:
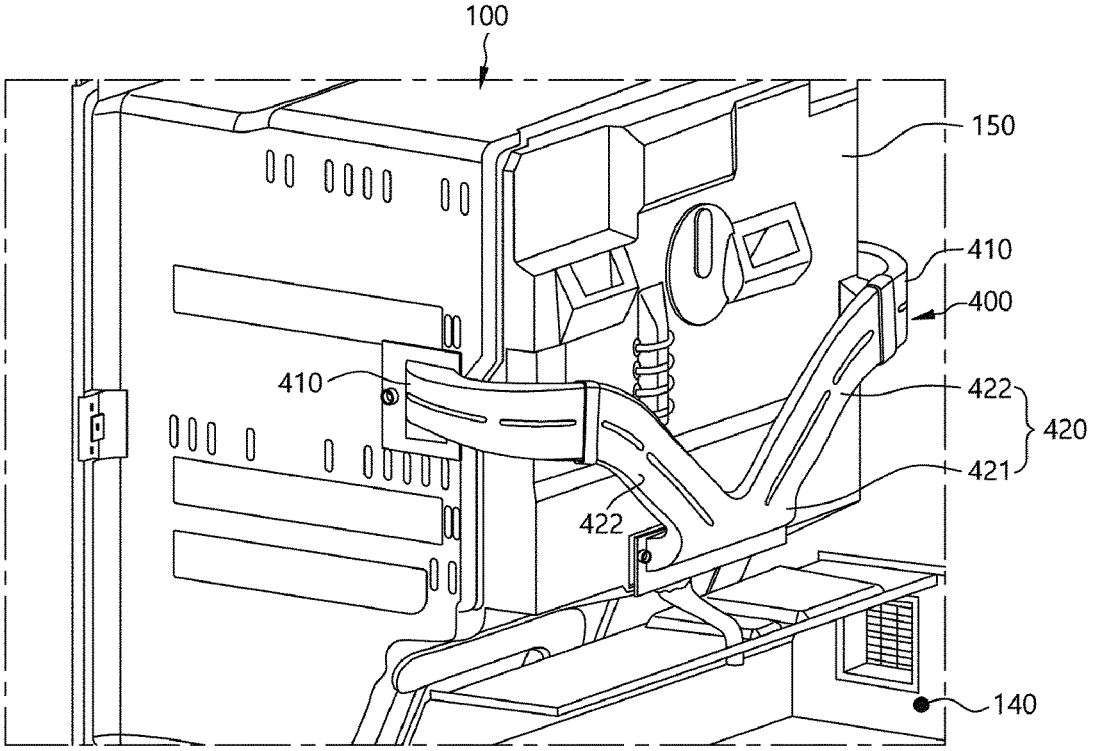
FIG. 7 is a perspective view illustrating the state of the rear of each of the first storage compartment and the second storage compartment to describe the installation shape of a circulating air path guide of the refrigerator according to the embodiment of the present disclosure.
Figure 8:
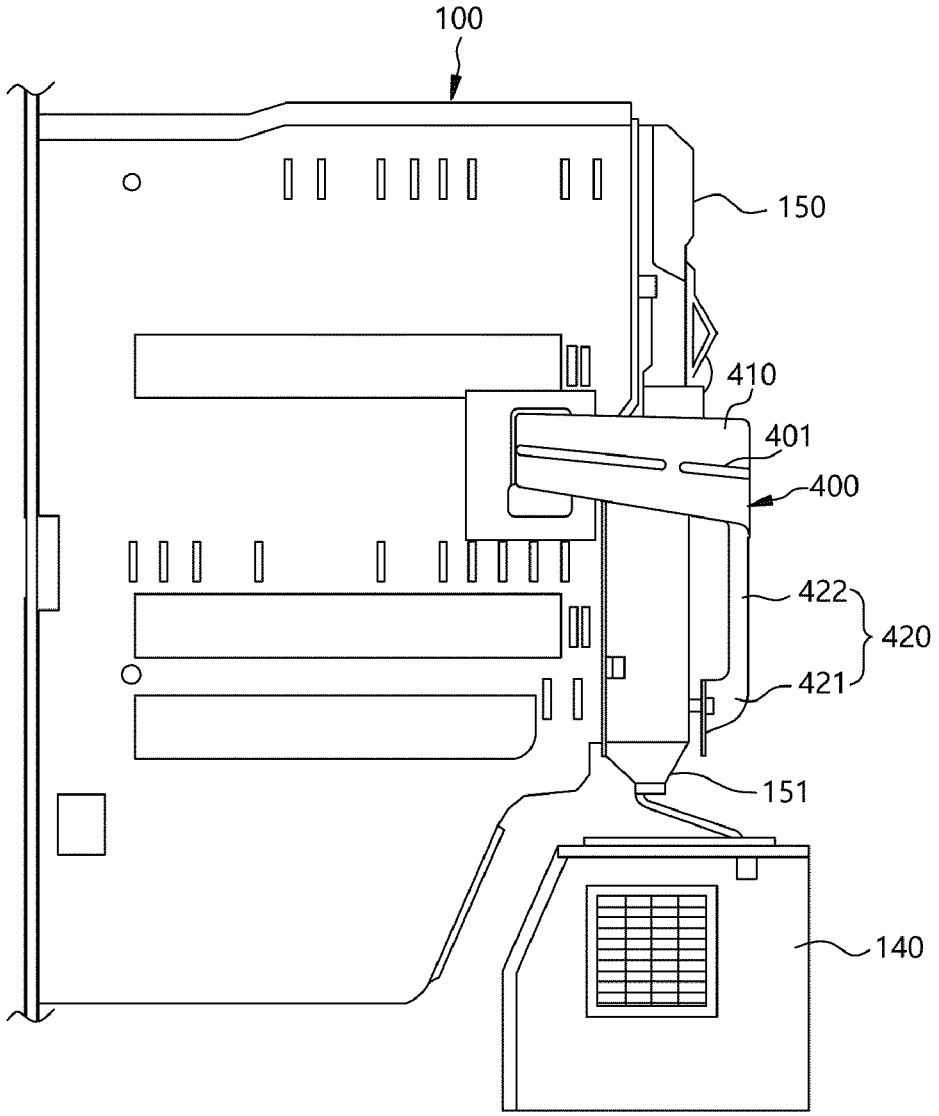
FIG. 8 is a side view illustrating the installation shape of the circulating air path guide of the refrigerator according to the embodiment of the present disclosure.
Figure 9:
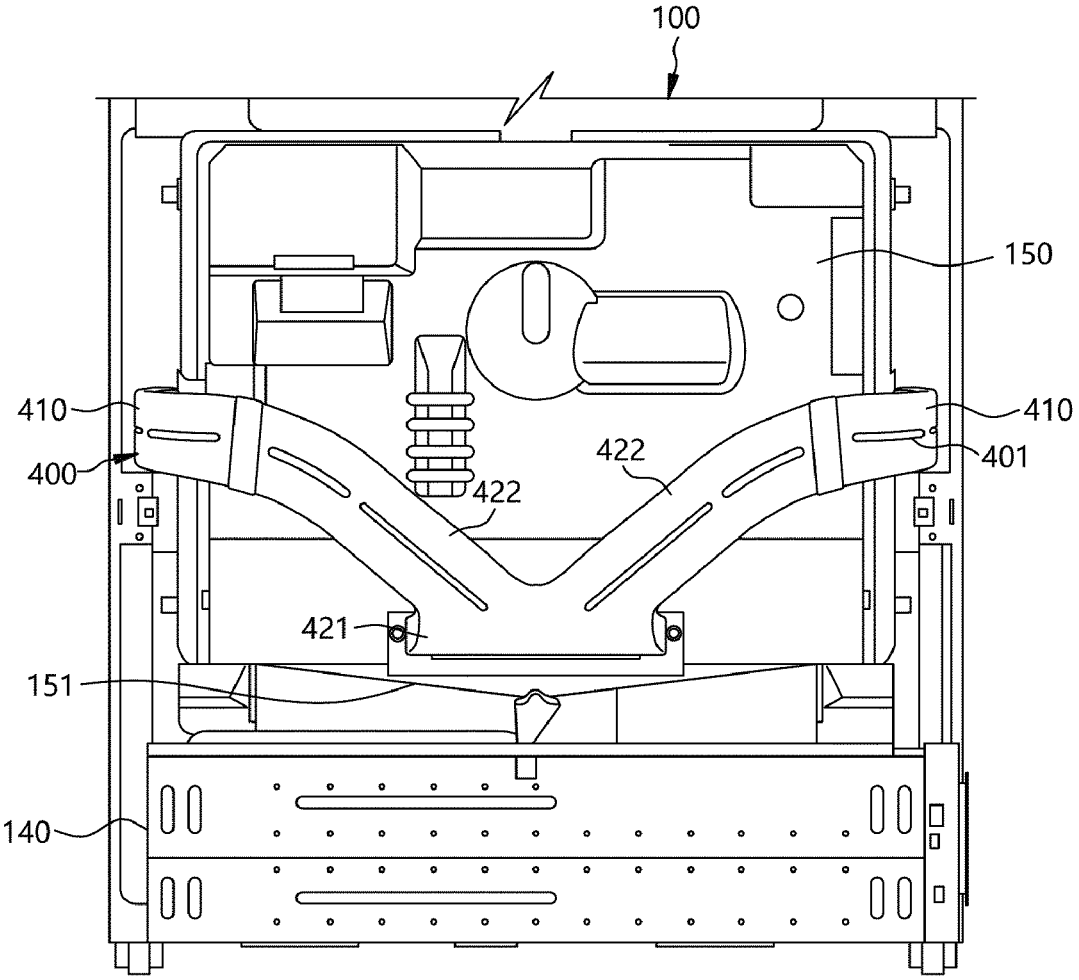
FIG. 9 is a rear view illustrating the installation shape of the circulating air path guide of the refrigerator according to the embodiment of the present disclosure.
Figure 10:
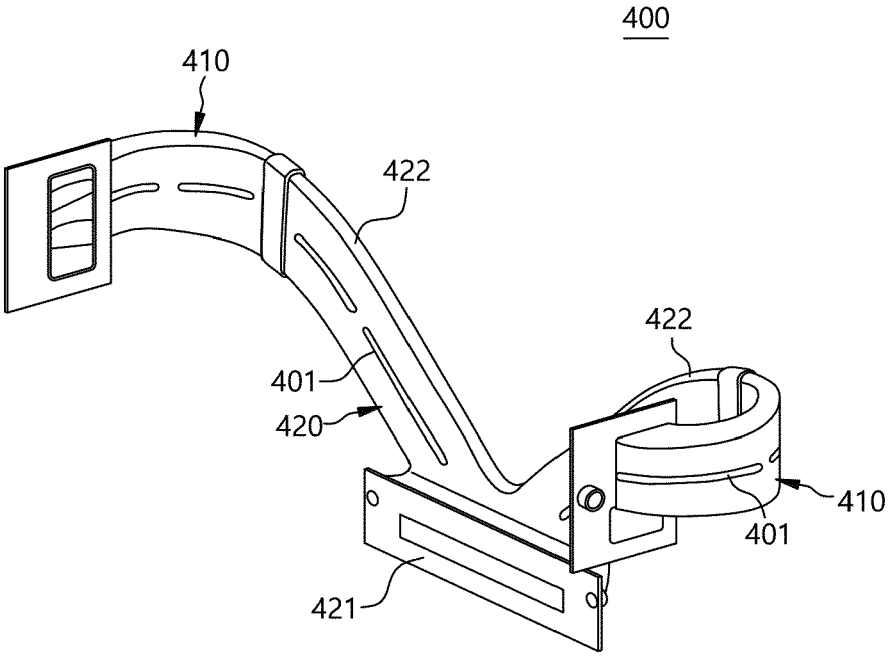
FIG. 10 is a front perspective view of the circulating air path guide of the refrigerator according to the embodiment of the present disclosure.
Figure 11:
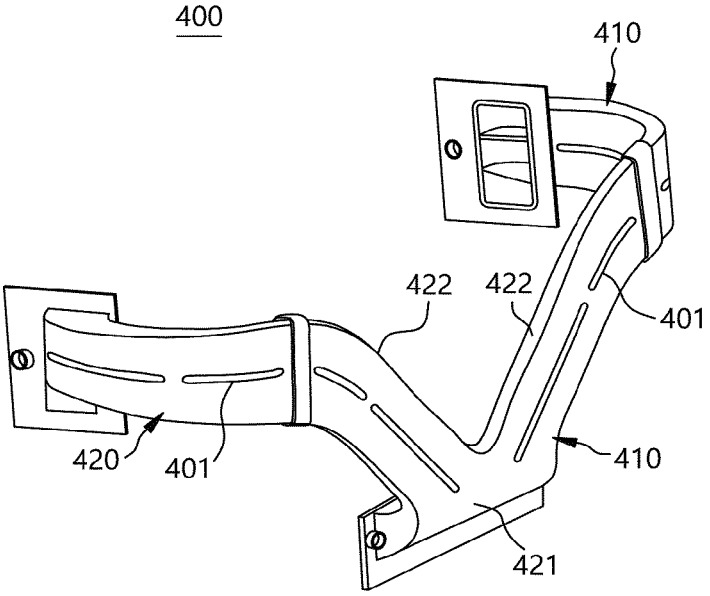
FIG. 11 is a rear perspective view of the circulating air path guide of the refrigerator according to the embodiment of the present disclosure.

Particularly, the third guide duct 224 may be installed to surround the circumference of the blower fan 240, wherein the air inlet part of the first guide duct 222 may be formed above the third guide duct 224 so as to communicate with the third guide duct 224 in a circumferential direction thereof, and the air inlet part of the second guide duct 223 may be formed at a side portion of the third guide duct 224 so as to communicate with the third guide duct 224 in a circumferential direction thereof. This is illustrated in FIG. 6.

In addition, the air outlet part of the first guide duct 222 may be configured to be branched to supply air toward the two first air discharge holes 212 formed in the front cover 210, and the air outlet part of the second guide duct 223 may be configured to be branched to supply air toward the two second air discharge holes 213 formed in the front cover 210.

Furthermore, the first guide duct 222 may be provided with a first damper 225 that opens and closes the associated flow path by a control operation, and the second guide duct 223 may be provided with a second damper 226 that opens and closes the associated flow path by a control operation.

Of course, each of the guide ducts 222, 223, and 224 may be formed on the rear surface of the front cover 210.

Meanwhile, a portion between the rear cover 220 and the inner casing 150 at which the evaporator 300 is located may be configured to be open downward. Accordingly, the cold air of the inside of the second storage compartment 130 passing through the inlet duct 214 may be introduced into the evaporator 300 between the rear cover 220 and the inner casing 150 through the open portion.

Additionally, the blower fan 240 may blow air such that the air is supplied to each of the storage compartments 120 and 130 after passing through the evaporator 300 located between the rear cover 220 and the inner casing 150.

Such a blower fan 240 may be configured as a centrifugal fan and may be configured to forcibly blow heat-exchanged cold air passing through the evaporator 300 between the rear cover 220 and the inner casing 150 to the first guide duct 222 and the second guide duct 223 after the heat exchanged cold air flows in the circumferential direction of the front surface of the rear cover 220.

Meanwhile, between the front cover 210 and the rear cover 220 constituting the grille fan assembly 200, a remaining portion except for air flow paths formed by the guide ducts 222, 223, and 224 may be made to be insulated by an insulating material 201 (see FIG. 5).

That is, the insulating material may prevent the cold heat of the evaporator 300 from being conducted directly to the front cover 210 to affect a temperature inside the first storage compartment 120 or the second storage compartment 130.

Next, the evaporator 300 will be described.

The evaporator 300 is a device which performs the heat exchange of air supplied to the first storage compartment 120 and the second storage compartment 130.

Such an evaporator 300 may be located in a flow path in which the air of the grille fan assembly 200 flows and may operate to perform the heat exchange of the air passing through the associated flow path such that the air is cooled.

In the embodiment of the present disclosure, the evaporator 300 is located between the inner casing 150 and the rear cover 220 of the grille fan assembly 200. That is, the evaporator 300 may perform the heat exchange of air flowing to the blower fan 240 through the lower open portion between the rear cover 220 and the inner casing 150 after passing through the inlet duct 214.

Particularly, the evaporator 300 may be located at a lower end portion between the rear cover 220 and the inner casing 150 which is the lower side of the blower fan 240. That is, the air inlet part of the evaporator 300 may be located at the rear of the second storage compartment 130 such that cold air inside the second storage compartment 130 passing through the inlet duct 214 is introduced directly into the evaporator 300.

In this case, the evaporator 300 is preferably located between the first storage compartment 120 and the second storage compartment 130. That is, the upper portion of the evaporator 300 may be located at the height of the rear of the lower end of the first storage compartment 120 such that the size (capacity) of the evaporator 300 can be sufficiently secured, and further, such that space for the formation of a structure (the first guide duct) for guiding an air flow to the upper side of the first storage compartment 120 can be secured.

Meanwhile, in the inner casing 150, a condensate reservoir 151 may be formed in the lower side of the evaporator 300 which is the lower side of the grille fan assembly 200 such that the condensate reservoir guides the discharge of condensate generated in the evaporator 300.

Next, the circulating air path guide 400 will be described.

The circulating air path guide 400 is a flow path guiding the flow of air inside the storage compartments to the evaporator 300.

In the embodiment of the present disclosure, for example, the circulating air path guide 400 is a flow path which guides the flow of air of the first storage compartment 120 to the evaporator 300.

That is, when it is considered that the second storage compartment 130 is configured such that air inside the second storage compartment 130 flows directly to the evaporator 300 through the inlet duct 214 of the grille fan assembly 200, the second storage compartment 130 may not require the circulating air path guide 400.

However, the first storage compartment 120 may be located at a position higher than the air inlet part of the evaporator 300, so it is preferably that the circulating air path guide 400 is used to guide the flow of air inside the first storage compartment 120 to the air inlet part without interfering with other flow paths.

Although not shown, the refrigerator may further be provided with a separate circulating air path guide which guides air of the inside of the second storage compartment 130 to the evaporator 300 or guides air of the inside of the upper storage compartment 110 to the upper evaporator 112, and may further be provided with a circulating air path guide which guides air of the inside of the upper storage compartment 110 to the evaporator 300.

The circulating air path guide 400 may be located between the inner casing 150 and the outer casing 160 constituting the main body casing 100.

That is, the circulating air path guide 400 may be configured as a separate flow path without being formed in the grille fan assembly 200.

Due to this, structural design for the grille fan assembly 200 may be easily made, and the thickness of the grille fan assembly 200 may be prevented from increasing.

In addition, the circulating air path guide 400 may receive the internal air of the first storage compartment 120 through the opposite wall surfaces of the first storage compartment 120 provided by the inner casing 150 and then the internal air may be gathered in the air inlet part of the evaporator 300 to be transferred thereto.

That is, the internal air of the first storage compartment 120 may be discharged evenly to the opposite wall surfaces of the inner casing 150 in which the first storage compartment 120 is located such that temperature deviation of each part inside the first storage compartment 120 can be reduced.

Such a circulating air path guide 400 may include the two storage compartment ducts 410 fixed respectively to the opposite wall surfaces of the inner casing 150 and communicating with the inside of the first storage compartment 120, and an evaporator duct 420 configured to guide an air flow to the air inlet part of the evaporator 300. This is illustrated in FIGS. 7 to 11.

Here, the first ends of the two storage compartment ducts 410 may be configured to be fixed respectively to the lower parts of the rears of the opposite outer wall surfaces of the inner casing 150 in which the first storage compartment 120 is located such that the internal air of the first storage compartment 120 is discharged through the two storage compartment ducts 410.

The second ends of the two storage compartment ducts 410 may be formed to be bent (or curved) by extending up to a portion behind the grille fan assembly 200.

In this case, an air outlet 122 may be formed in each of the opposite wall surfaces of the inner casing 150 in which the first storage compartment 120 is located, and the first ends of the two storage compartment ducts 410 may be installed to communicate with the air outlets 122.

Furthermore, the evaporator duct 420 may include a communicating end 421 in close contact with and fixed to the central lower portion of the rear surface of the inner casing 150 constituting the grille fan assembly 200, and two connecting ends 422 connecting the two storage compartment ducts 410 with the communicating end 421.

In this case, the communicating end 421 may be configured to communicate with the front space of the inner casing 150, and air may be supplied through the communicating end 421 to the lower part (the air inlet part) of the evaporator 300 located between the rear cover 220 and the inner casing 150.

Particularly, the communicating end 421 may be configured such that air can be supplied to a position between the evaporator 300 and the condensate reservoir 151 in the lower part of the inner casing 150. Due to such a structure, even if cold air flowing in the circulating air path guide 400 includes moisture, the moisture may flow down to the condensate reservoir 151.

In addition, the two connecting ends 422 may respectively extend to be inclined (or curved) outward gradually toward the upper sides of the communicating end 421 from the opposite sides of the upper surface of the communicating end 421 and may be connected to the two storage compartment ducts 410 located at the rear surfaces of the opposite sides of the inner casing 150.

Particularly, the connecting ends 422 may be coupled removably to the storage compartment ducts. That is, the connecting ends 422 and the storage compartment ducts may be separately manufactured from each other and then may be assembled with each other.

The circulating air path guide 400 may be configured to have multiple curvatures to be bent, inclined, and curved, so when the entire portion of such a structure is configured integrally, the structure may be difficult to be formed. Accordingly, the circulating air path guide 400 may be manufactured by being divided into three parts such as the two storage compartment ducts 410 and the evaporator duct 420 such that the three parts are tightly coupled to each other.

Of course, after the two connecting ends 422 of the evaporator duct 420 are inserted into and coupled to the two storage compartment ducts 410, the two connecting ends 422 and the two storage compartment ducts 410 may be welded to each other to achieve airtightness therebetween and to be integrated with each other.

Furthermore, the circulating air path guide 400 described above may be configured as a flat pipe structure having an angled shape. Such a structure allows air to efficiently flow and may avoid interference from surrounding components due to thickness reduced as much as possible.

In this case, the circulating air path guide 400 may include a plurality of ribs 401 formed on a surface thereof such that the undesired bending deformation of the circulating air path guide 400 can be prevented.

Meanwhile, although not shown, the connecting ends 422 and the storage compartment ducts may be configured to be connected to each other via separate extension tubes or connectors.

In the above-described refrigerator according to the embodiment of the present disclosure, individual temperature control for each of the storage compartments 110, 120, and 130 may be performed.

That is, the temperature control of the upper storage compartment 110 may be performed by controlling the operations of the upper evaporator 112 and the upper blower fan 113.

On the other hand, the temperature control of each of the first storage compartment 120 and the second storage compartment 130 may be performed by controlling the operations of the evaporator 300, the blower fan 240, and each of the dampers 225 and 226.

That is, in the refrigerator according to the embodiment of the present disclosure, the first storage compartment 120 and the second storage compartment 130 may be configured to be opened and closed by the drawer-type doors 121 and 131, respectively, and may have the same or similar storage temperature ranges. Accordingly, the temperature of each of the first storage compartment 120 and the second storage compartment 130 may be controlled by the one evaporator 300.

Hereinafter, the temperature control process of each of the first storage compartment 120 and the second storage compartment 130 will be described in more detail.

First, the temperature control of the first storage compartment 120 may be performed by controlling the operations of the evaporator 300, the blower fan 240, and each of the dampers 225 and 226.

That is, the first damper 225 and the second damper 226 may be manipulated to open the first guide duct 222 and to close the second guide duct 223, and the operation of the blower fan 240 may be controlled such that cold air (air which is heat exchanged with the evaporator) passing through the evaporator 300 is supplied to the first storage compartment 120 through the first guide duct 222.

In this case, the cold air guided to the first guide duct 222 may be introduced through the two first air discharge holes 212 formed in the front cover 210 to the opposite sides of the internal space of the first storage compartment 120.

Particularly, when it is considered that the first air discharge hole 212 is configured to be inclined toward the upper space of the first storage compartment 120, cold air may be sufficiently supplied up to the front side of the inside of the first storage compartment 120.

Additionally, the cold air supplied to the front side of the inside of the first storage compartment 120 may flow to the lower portion of the inside of the first storage compartment 120 and then may flow rearward to be repeatedly circulated.

Particularly, the cold air circulating in the first storage compartment 120 may be discharged through the two air outlets 122 formed in the lower parts of the rears of the opposite wall surfaces of the first storage compartment 120 into the two storage compartment ducts 410 of the circulating air path guide 400.

Additionally, the cold air discharged in this manner may be guided to the air inlet part of the evaporator 300 through the evaporator duct 420.

That is, the cold air discharged to the two storage compartment ducts 410 may flow through the two connecting ends 422 of the evaporator duct 420 connected to the two storage compartment ducts 410 and then may be gathered in the communicating end 421, and may continuously flow through the rear surface of the inner casing 150, to which the communicating end 421 is mounted, to the lower side of the evaporator 300 located between the inner casing 150 and the rear cover 220.

Next, the cold air may be forced to pass through the evaporator 300 due to the air intake force of the blower fan 240 to be heat exchanged again, and may be supplied back into the first storage compartment 120 by the guidance of the first guide duct 222 as described above.

The temperature control described above may be continuously performed until the first storage compartment 120 reaches a preset temperature, and when the first storage compartment 120 reaches the preset temperature, the first damper 225 may operate to close the first guide duct 222 such that additional supply of cold air to the first storage compartment 120 stops.

Next, the temperature control of the second storage compartment 130 may be performed by controlling the operations of the evaporator 300, the blower fan 240, and each of the dampers 225 and 226.

That is, the first damper 225 and the second damper 226 may be manipulated to open the second guide duct 223 and to close the first guide duct 222.

In addition, the operation of the blower fan 240 may be controlled such that cold air (air which is heat exchanged with the evaporator) passing through the evaporator 300 is supplied into the second storage compartment 130 through the second guide duct 223.

In this case, the cold air guided to the second guide duct 223 may be introduced through the two second air discharge holes 213 formed in the front cover 210 to the opposite sides of the internal space of the second storage compartment 130.

Additionally, the cold air supplied into the second storage compartment 130 may repeat the flow of circulating in the second storage compartment 130.

Particularly, the cold air circulating in the second storage compartment 130 may flow rearward along the bottom surface of the second storage compartment 130, and continuously may flow through the inlet duct 214 formed in the lower end of the front cover 210 to the lower side of the evaporator 300 located between the rear cover 220 of the grille fan assembly 200 and the inner casing 150.

Next, the cold air may be forced to pass through the evaporator 300 located between the rear cover 220 and the inner casing 150 due to the air intake force of the blower fan 300 to be heat exchanged, and may be supplied back into the second storage compartment 130 by the guidance of the second guide duct 223.

The operation described above may be continuously performed until the second storage compartment 130 reaches a preset temperature, and when the second storage compartment 130 reaches the preset temperature, the second damper 226 may operate to close the second guide duct 223 such that additional supply of cold air to the second storage compartment 130 stops.

Meanwhile, the temperature control of each of the first storage compartment 120 and the second storage compartment 130 described above is not limited to proceeding only in the manner of the above-described embodiment.

That is, as in the above-described embodiment, during the temperature control of one storage compartment 120 or 130, the complete stopping of the supply of cold air to another storage compartment 120 or 130 may be advantageous for accurate temperature control and rapid arrival at a preset temperature, but during the temperature control of one storage compartment, cold air may be controlled to be partially supplied to another storage compartment.

This may be performed by adjusting the opening amount of the first guide duct 222 by the first damper 225 or by adjusting the opening amount of the second guide duct 223 by the second damper 226.

Of course, during the temperature control of each of the first storage compartment 120 and the second storage compartment 130 described above, an operation for the temperature control of the upper storage compartment 110 may or may not be performed.

That is, the temperature control of the upper storage compartment 110 may be performed by controlling the operations of the upper evaporator 112 and the upper blower fan 113, and thus may be individually performed irrespective of the first storage compartment 120 and the second storage compartment 130.

However, when it is considered that the upper evaporator 112 and the evaporator 300 are operated by the one compressor 141, during the temperature control of the upper storage compartment 110, the temperature control of the first storage compartment 120 or the second storage compartment 130 may not be performed.

After all, in the refrigerator of the present disclosure, air contained inside one storage compartment (the first storage compartment 120) of the two storage compartments 120 and 130 whose temperatures are controlled by the evaporator 300 may be reintroduced into the evaporator 300 by the circulating air path guide 400 to be circulated. Accordingly, even if the evaporator 300 having small capacity is applied, freezing or refrigeration temperature may be freely embodied.

In addition, in the refrigerator of the present disclosure, a separate circulating air path guide 400 may be used, thereby preventing the flow interference of air reintroduced into the evaporator 300 from the second storage compartment 130 with air reintroduced into the evaporator 300 from the first storage compartment 120.

Furthermore, in the refrigerator of the present disclosure, the circulating air path guide 400 may be configured to discharge air through the opposite wall surfaces of the inner casing 150 in which the first storage compartment 120 is located, thereby releasing the concern of air freezing.

That is, when a flow path is formed on the lower part of the rear surface of the first storage compartment 120 or on a bottom surface thereof to receive cold air discharged from the upper side of the rear surface of the first storage compartment 120, the cold air may not be efficiently discharged and may freeze. However, an air discharge position may be located at each of the opposite wall surfaces of the first storage compartment 120, thereby preventing air freezing.

In addition, in the refrigerator of the present disclosure, the one evaporator 300 and the two dampers 225 and 226 may control different temperatures of the two storage compartments 120 and 130, thereby simplifying the structure of temperature control.

Furthermore, in the refrigerator of the present disclosure, the evaporator 300 may be installed to be located at a portion behind the partitioning frame 102 partitioning the two storage compartments 120 and 130 from each other, thereby facilitating the flow of air discharged from the second storage compartment 130 toward the air inlet part of the evaporator 300.

Furthermore, the refrigerator of the present disclosure may be configured such that air is introduced into and passes through the evaporator 300 from the lower side thereof and then flows to the blower fan 240 located above the evaporator 300, thereby preventing the loss of an air flow and improving the heat exchange efficiency of the evaporator 300.

In addition, in the refrigerator of the present disclosure, the front cover 210 of the grille fan assembly 200 may be provided to constitute the rear wall of the first storage compartment 120 and the second storage compartment 130, thereby simplifying the structure of the rear wall thereof.

Furthermore, in the refrigerator of the present disclosure, the guide duct 222 and 223 may be configured by being divided into the first guide duct 222 for supplying cold air into the first storage compartment 120 and the second guide duct 223 for supplying cold air into the second storage compartment 130, and the guide ducts 222 and 223 may be respectively provided with the dampers 225 and 226 for opening and closing flow paths, so individual temperature control for each of the storage compartments 120 and 130 may be performed.

Additionally, in the refrigerator of the present disclosure, the evaporator 300 may be located at a lower portion of space between the rear cover 220 and the inner casing 150, thereby facilitating a structure design for air introduction from each of the storage compartments 120 and 130.

In addition, in the refrigerator of the present disclosure, the evaporator 300 may be located between the first storage compartment 120 and the second storage compartment 130, thereby sufficiently securing the size (capacity) of the evaporator 300, and securing space for forming the first guide duct which guides an air flow to the upper side of the first storage compartment 120.

Furthermore, in the refrigerator of the present disclosure, the inlet duct 214 may be formed under the front cover 210, thereby efficiently guiding cold air contained inside the second storage compartment 130 to the evaporator 300.

Additionally, the refrigerator of the present disclosure may be configured such that the flow of circulating cold air is guided to the lower side of the evaporator 300 through the circulating air path guide 400 instead of being introduced into the center or side portion of the evaporator 300, thereby minimizing the loss of an air flow.

In addition, in the refrigerator of the present disclosure, the circulating air path guide 400 may be configured to receive cold air contained inside the first storage compartment 120 from the opposite sides of the first storage compartment 120, thereby evenly distributing the cold air of the inside of the first storage compartment 120 to opposite sides thereof.

Furthermore, in the refrigerator of the present disclosure, the circulating air path guide 400 may be configured to receive cold air contained inside the first storage compartment 120 from the lower ends of the rears of the opposite sides of the first storage compartment 120, thereby enabling the cold air introduced into the first storage compartment 120 to sufficiently cool the inside of the first storage compartment 120 and then to be discharged.

Furthermore, in the refrigerator of the present disclosure, the circulating air path guide 400 may be configured by being divided into the two storage compartment ducts 410 and the evaporator duct 420, thereby facilitating the manufacturing of the circulating air path guide 400.

Furthermore, in the refrigerator of the present disclosure, the evaporator duct 420 may include the two connecting ends 422 which are connected to the two storage compartment ducts 410, respectively, and thus air introduced into the storage compartment ducts 410 from the opposite sides of the inside of the first storage compartment 120 may be gathered in the communicating end 421 to be supplied to the evaporator 300, thereby reducing the loss of an air flow.

In addition, in the refrigerator of the present disclosure, the two connecting ends 422 of the evaporator duct 420 and the two storage compartment ducts 410 may be coupled removably to each other, thereby facilitating disassembly and reassembly thereof for maintenance.

The invention claimed is:

1. A refrigerator comprising:

an inner casing having a first storage compartment and a second storage compartment located under the first storage compartment;

an outer casing disposed outside the inner casing;

doors configured to open and close the first storage compartment and the second storage compartment, respectively;

a partitioning frame that partitions the first storage compartment and the second storage compartment vertically from each other;

a grille fan assembly located in the first and second storage compartments of the inner casing, the grille fan assembly comprising a blower fan and being configured to guide supply of air blown by the blower fan to each of the first and second storage compartments;

an evaporator provided between a rear wall surface of an inside of the inner casing and a rear surface of the grille fan assembly, the evaporator being configured to perform a heat exchange of air; and a circulating air path guide located between the inner casing and the outer casing and configured to guide an internal air of the first storage compartment to the evaporator, wherein the evaporator is located behind the partitioning frame, wherein a first end of the circulating air path guide is connected to a side wall of the inner casing and fluidly connected to the first storage compartment, and a second end of the circulating air path guide is connected to the rear wall surface of the inner casing and fluidly connected to a space at which the evaporator is located, wherein an upper portion of the evaporator is located above the partitioning frame, and a lower portion of the evaporator is located below the partitioning frame, and wherein an air inlet of the circulating air path guide is located above the partitioning frame, and an air outlet of the circulating air path guide is located below the partitioning frame.

2. The refrigerator of claim 1, wherein the grille fan assembly further comprises:

a first guide duct configured to guide supply of air blown from the blower fan to one of the first and second storage compartments; and a second guide duct configured to guide supply of air blown from the blower fan to the other one of the first and second storage compartments.

3. The refrigerator of claim 2, wherein the grille fan assembly defines two first air discharge holes at an upper part of the grille fan assembly, the two first air discharge holes being configured to discharge air into the first storage compartment, wherein one of the two first air discharge holes is disposed at a first side with respect to the blower fan, and the other one of the two first air discharge holes is disposed at a second side opposite to the first side with respect to the blower fan, and wherein the first guide duct is branched to supply air to each of the two first air discharge holes.

4. The refrigerator of claim 2, wherein the grille fan assembly defines two lower air discharge holes at a lower part of the grille fan assembly, the two lower air discharge holes being disposed at opposite sides with respect to the blower fan and configured to discharge air into the second storage compartment, wherein one of the two lower air discharge holes is disposed at a first side with respect to the blower fan, and the other one of the two lower air discharge holes is disposed at a second side opposite to the first side with respect to the blower fan, and wherein the second guide duct is branched to supply air to each of the two lower air discharge holes.

5. The refrigerator of claim 1, wherein an air outlet part of the evaporator is located at a side higher than the partitioning frame.

6. The refrigerator of claim 1, wherein an air inlet part of the evaporator is located at a side lower than the partitioning frame.

7. The refrigerator of claim 1, wherein the second end of the circulating air path guide is configured to guide an air flow to a lower side of the evaporator.

8. The refrigerator of claim 1, wherein the first end of the circulating air path guide is configured to receive the internal air of the first storage compartment from opposite sides of the first storage compartment.

9. The refrigerator of claim 1, wherein the circulating air path guide is connected to a rear portion of the first storage compartment when viewed relative to a middle portion of the first storage compartment.

10. The refrigerator of claim 1, wherein the circulating air path guide is connected to a lower portion of the first storage compartment when viewed relative to a middle portion of the first storage compartment.

11. The refrigerator of claim 1, wherein the circulating air path guide comprises:

two storage compartment ducts fixed respectively to opposite wall surfaces of the first storage compartment and configured to receive an internal air of the first storage compartment; and an evaporator duct configured to receive the air from the two storage compartment ducts and to guide a flow of the air to an air inlet part of the evaporator.

12. The refrigerator of claim 11, wherein the evaporator duct comprises:

a communicating end that is in fluid communication with the air inlet part of the evaporator through the rear wall surface of the inner casing; and two connecting ends connected respectively to the two storage compartment ducts and configured to receive air from each of the two storage compartment ducts and to transfer the air to the communicating end.

13. The refrigerator of claim 12, wherein the two connecting ends of the evaporator duct and the two storage compartment ducts are configured to be coupled removably to each other.

14. The refrigerator of claim 12, wherein the two connecting ends are respectively configured to be inclined or curved outward gradually toward upper sides of the communicating end from the communicating end.

15. The refrigerator of claim 1, wherein the air inlet of the circulating air path guide is defined at the first end of the circulating air path guide and configured to receive air from the first storage compartment, and wherein the air outlet of the circulating air path guide is defined at the second end of the circulating air path guide and configured to supply air to the evaporator.

16. A refrigerator comprising:

an inner casing having a first storage compartment and a second storage compartment located under the first storage compartment;

an outer casing disposed outside the inner casing;

doors configured to open and close the first storage compartment and the second storage compartment, respectively;

a partitioning frame that partitions the first storage compartment and the second storage compartment vertically from each other;

a grille fan assembly located in the first and second storage compartments of the inner casing, the grille fan assembly comprising a blower fan and being configured to guide supply of air blown by the blower fan to each of the first and second storage compartments;

an evaporator provided between a rear wall surface of an inside of the inner casing and a rear surface of the grille fan assembly, the evaporator being configured to perform a heat exchange of air; and a circulating air path guide located between the inner casing and the outer casing and configured to guide an internal air of the first storage compartment to the evaporator, wherein the evaporator is located behind the partitioning frame, wherein a first end of the circulating air path guide is connected to a side wall of the inner casing and fluidly connected to the first storage compartment, and a second end of the circulating air path guide is connected to the rear wall surface of the inner casing and fluidly connected to a space at which the evaporator is located, wherein the grille fan assembly further comprises:

a first guide duct configured to guide supply of air blown from the blower fan to one of the first and second storage compartments, and a second guide duct configured to guide supply of air blown from the blower fan to the other one of the first and second storage compartments, wherein the grille fan assembly defines two lower air discharge holes at a lower part of the grille fan assembly, the two lower air discharge holes being disposed at opposite sides with respect to the blower fan and configured to discharge air into the second storage compartment, wherein one of the two lower air discharge holes is disposed at a first side with respect to the blower fan, and the other one of the two lower air discharge holes is disposed at a second side opposite to the first side with respect to the blower fan, and wherein the second guide duct is branched to supply air to each of the two lower air discharge holes.

17. A refrigerator comprising:

an inner casing having a first storage compartment and a second storage compartment located under the first storage compartment;

an outer casing disposed outside the inner casing;

doors configured to open and close the first storage compartment and the second storage compartment, respectively;

a partitioning frame that partitions the first storage compartment and the second storage compartment vertically from each other;

a grille fan assembly located in the first and second storage compartments of the inner casing, the grille fan assembly comprising a blower fan and being configured to guide supply of air blown by the blower fan to each of the first and second storage compartments;

an evaporator provided between a rear wall surface of an inside of the inner casing and a rear surface of the grille fan assembly, the evaporator being configured to perform a heat exchange of air; and a circulating air path guide located between the inner casing and the outer casing and configured to guide an internal air of the first storage compartment to the evaporator, wherein the evaporator is located behind the partitioning frame, wherein a first end of the circulating air path guide is connected to a side wall of the inner casing and fluidly connected to the first storage compartment, and a second end of the circulating air path guide is connected to the rear wall surface of the inner casing and fluidly connected to a space at which the evaporator is located, and wherein the circulating air path guide comprises:

two storage compartment ducts fixed respectively to opposite wall surfaces of the first storage compartment and configured to receive an internal air of the first storage compartment, and an evaporator duct configured to receive the air from the two storage compartment ducts and to guide a flow of the air to an air inlet part of the evaporator.

* * * * *